US008618931B2

(12) United States Patent
Rossmann et al.

(10) Patent No.: US 8,618,931 B2
(45) Date of Patent: Dec. 31, 2013

(54) POSITION-MONITORING DEVICE FOR PERSONS IN A TUNNEL SYSTEM

(75) Inventors: Martin Rossmann, Hüttenberg-Reiskirchen (DE); Johannes Hertel, Arnsberg (DE)

(73) Assignee: Rittal GmbH & Co. KG, Herborn (DE)

( * ) Notice: Subject to any disclaimer, the term of this patent is extended or adjusted under 35 U.S.C. 154(b) by 407 days.

(21) Appl. No.: 12/736,556

(22) PCT Filed: Apr. 16, 2009

(86) PCT No.: PCT/EP2009/002780
§ 371 (c)(1),
(2), (4) Date: Feb. 7, 2011

(87) PCT Pub. No.: WO2009/127411
PCT Pub. Date: Oct. 22, 2009

(65) Prior Publication Data

US 2011/0260856 A1 Oct. 27, 2011

(30) Foreign Application Priority Data

Apr. 18, 2008 (DE) ..... 20 2008 005 467 U

(51) Int. Cl.
*G08B 21/00* (2006.01)

(52) U.S. Cl.
USPC ..... 340/539.13; 340/573.1; 455/404.2

(58) Field of Classification Search
USPC ..... 340/539.1, 539.13, 573.1, 539.15, 340/539.21; 455/404.1, 404.2, 456.1
See application file for complete search history.

(56) References Cited

U.S. PATENT DOCUMENTS

| | | | | |
|---|---|---|---|---|
| 4,608,716 | A * | 9/1986 | Brumfield | 2/2.5 |
| 4,709,330 | A | 11/1987 | Yokoi et al. | |
| 5,895,445 | A | 4/1999 | Hong et al. | |
| 2002/0104013 | A1 | 8/2002 | Ghazarian | |
| 2004/0217864 | A1 | 11/2004 | Nowak et al. | |
| 2006/0219783 | A1 | 10/2006 | Willis | |
| 2008/0042844 | A1 | 2/2008 | Christopher | |

FOREIGN PATENT DOCUMENTS

| | | | |
|---|---|---|---|
| CN | 1694569 | A | 11/2005 |
| DE | 103 23 209 | A1 | 8/2004 |
| DE | 10 2005 055 102 | A1 | 8/2006 |
| DE | 10 2006 034 857 | A1 | 1/2008 |

(Continued)

OTHER PUBLICATIONS

Co-Pending U.S. Appl. No. 12/735,526, filed Jul. 23, 2010; inventors Martin Rossman et al.; title Monitoring Unit for the Operation of Control Cabinet Devices.

(Continued)

*Primary Examiner* — Jeffery Hofsass
(74) *Attorney, Agent, or Firm* — Pauley Petersen & Erickson

(57) ABSTRACT

A position-monitoring device for persons in tunnel systems having an evaluation device. Reliable determination of the position of persons in the tunnel system is achieved because a locally distributed arrangement of wireless transceiver units is installed in the tunnel system, at fixed anchoring points known to the evaluation device, in the spaces to be monitored. Persons are equipped with mobile sensors. Transceiver units have wireless data-transmission interfaces via which, on one hand, can be placed in a wireless data-transmitting connection to the mobile and, on the other hand, can be placed in a wire-bound or wireless data-transmitting connection to the evaluation device. Programs with which the position of the persons can be determined on the basis of detection data of the transceiver units are stored in the evaluation device.

26 Claims, 11 Drawing Sheets

(56) References Cited

FOREIGN PATENT DOCUMENTS

| | | | |
|---|---|---|---|
| EP | 0 826 278 | B1 | 3/1998 |
| EP | 1 047 244 | A1 | 10/2000 |
| GB | 2 324 630 | A | 10/1998 |
| RU | 2 284 542 | C2 | 9/2006 |
| WO | WO 97/01154 | | 1/1997 |
| WO | WO 01/06401 | A1 | 1/2001 |
| WO | WO 2005/076553 | A1 | 8/2005 |

OTHER PUBLICATIONS

Counterpart Chinese Patent Application 2009801131731, "Text of the First Office Action" (translation), Nov. 27, 2012.

* cited by examiner

POSITION-MONITORING DEVICE FOR PERSONS IN A TUNNEL SYSTEM

BACKGROUND OF THE INVENTION

1. Field of the Invention

This invention relates to a position-monitoring device for persons in tunnel systems, equipped with an evaluation device.

2. Discussion of Related Art

German Patent Reference DE 10 2005 055 102 A1 discloses a method for detecting, locating, and managing objects with an inventory or resources management system and an associated apparatus. In this known method, mobile object nodes and stationary anchor nodes, each with a processing unit, a transceiver unit, a memory unit, a power supply, and an individual identification, and one or more mobile or stationary access nodes that also have an input/output unit, form a self-generating network for wireless communication. The anchor nodes in this case are situated at known positions and each object to be monitored is assigned to an object node. A data exchange between the individual nodes takes place either directly or by a multi-hop process and in order to monitor the objects, the access node or nodes query data from the object nodes and/or receive data transmitted from the object nodes, either automatically or by individual request. The method permits a spontaneous overview of current numbers and current locations of the respective objects as well as an optional overview of other information about the object and its surroundings, such as temperature, pressure, or humidity of the surrounding air. In addition, it is possible to predetermine permissible areas, such as on the ground floor of a building, that can be assigned to the object, such as inside a hospital. Objects can be measuring devices inside the hospital. In addition, in the area of the planning and monitoring of personnel deployment, a person can be assigned to an object node and the network can be used to request the location of the person and an access node can be used to actively communicate with the person at the object node. Determining the position of an object node can be carried out, for example, by evaluating proximity relationships of the nodes in the network or on the basis of known positions of anchor nodes as well as by evaluating reception signals at other nodes. This prior art reference does not relate to monitoring persons in tunnel systems. In particular, such monitoring involves conditions that make it difficult to reliably determine the position of persons and the areas in which they are located.

A position-determining device for persons taught by German Patent Reference DE 10 2006 034 857 A1 involves locating them in automated factories. In this case, the persons wear RFID tags that are read with the aid of reader devices provided in field devices. For this purpose, it is difficult to transmit variable data that arise with changing environmental conditions of persons or when people change positions.

European Patent Reference EP 1 047 244 A1 discloses locating a mobile node at a physical location in a network that can be a variety of sizes, such as occupying an office or extending across several countries. In particular, it is also possible to identify the mobile node in a foreign network. The mobile nodes can be connected to the network in various ways, such as by a local network, an infrared connection, or the like. This prior art reference involves selecting transmission paths for the data packets or IP packets, but not locating persons. In particular, specific problems arise when attempting to locate persons in a tunnel system.

PCT International Publication WO 2005/076553 A1 demonstrates the determination of the physical location in a network of nodes in which the distance to various nodes is used for locating purposes. This prior art reference also does not address solving problems that arise when attempting to locate persons in a tunnel system.

European Patent Reference EP 0 826 278 B1 demonstrates a method for routing data packets within a wireless packet-hopping network as well as a wireless network and nodes for using the method. It involves controlling the message paths for packet transmission, but not attempting to locate persons in a tunnel system.

Other devices for position-determining or locating are disclosed in PCT International Publication WO 01/06401 A1, U.S. Patent Reference US 2002/0104013 A1, German Patent Reference DE 103 23 209 A1, German Patent Reference DE 10 2006 034 857 A1, German Patent Reference DE 10 2005 055 102 A1, U.S. Patent Reference US 2004/0217864 A1, and U.S. Patent Reference US 2006/0219783 A1, most of which involve position-determination in buildings, frequently on the basis of RFID technology.

SUMMARY OF THE INVENTION

One object of this invention is to provide a position-monitoring device for persons in tunnel systems, which achieves a reliable position determination in this environment.

This object and others are attained by the defining characteristics of this invention as described in this specification and in the claims. In this case, a locally distributed arrangement of wireless transceiver units, each equipped with a wireless data-transmission device, is installed in the spaces to be monitored in the tunnel system, at fixed anchor points that are known to the evaluation device. The persons have mobile sensors. The transceiver units are equipped with data-transmission interfaces via which can be placed in a wireless data-transmitting connection to the mobile sensors and can also be placed in a wired or wireless data-transmitting connection to the evaluation device. Programs which can be used to determine the position of the persons on the basis of detection data of the transceiver units are stored in the evaluation device.

The transceiver units, which are suitably positioned at prominent locations in the tunnel system for the most complete possible determination of the location of persons, the data-transmission interfaces, and the evaluation device permit a rapid, reliable determination of the locations of the persons in the tunnel system. The data transmission between the transceiver units and the evaluation device can also make use of a plurality of connections between the transceiver units themselves in order, for example, to convey detection data from a distant location in the tunnel system to a central location.

For personnel safety, it is advantageous to provide mobile and/or stationary sensors for detecting hazardous states of persons and/or hazardous areas in the tunnel system and to embody or design the evaluation device to recognize dangerous situations.

In one advantageous embodiment for detecting the location of a person, the evaluation device is embodied for determining position on the basis of simultaneous detection data from a plurality of transceiver units by triangulation.

Other advantageous embodiments for position detection include that the evaluation device is embodied for determining position on the basis of a travel time measurement of the signals of the mobile sensors and/or on the basis of their signal strengths by the detection data.

An advantageous evaluation and position determination is facilitated if the data-transmission paths between the mobile sensors and the transceiver units and/or the data-transmission paths between the evaluation device and the transceiver units each is embodied to be bi-directional.

One advantageous design of the position-monitoring device includes the fact that the transceiver units are installed in existing devices of the electrical installation, particularly in lights and/or components of a signaling system.

One embodiment that is advantageous for monitoring and protecting personnel includes the tunnel system being divided into subsections, which are classified into different hazard levels, and related classification data are stored in the evaluation device and are or can be associated with the determined position data.

The monitoring and protection of personnel is accomplished by a measurement system with stationary sensors for physical states being installed in the tunnel system, in which the sensor data of the measurement system are supplied to the evaluation device, and it is possible to relate these data to the detection data.

Further protections of personnel in the tunnel system or in a building are made by measures if a personnel warning system is provided and the issuance of warning signals is triggered in the evaluation device or the transceiver units depending on the position of the person.

One embodiment that is advantageous for personnel protection includes that personnel are assigned additional mobile sensors that are embodied for detecting vital signs of the personnel, in particular blood pressure, respiration, EKG, and/or movement, and the, evaluation device is embodied for evaluating detected vital signs.

Other advantageous embodiments include that they are embodied for three-dimensional position detection and display, a guidance system is provided to assist support personnel in rescuing a person in danger, and the mobile and stationary sensors are embedded into the guidance system for support personnel, and in addition, a radio transmission by the chirp spread spectrum technique is used for the wireless data transmission.

BRIEF DESCRIPTION OF THE DRAWINGS

This invention is described in greater detail in view of exemplary embodiments, with reference to the drawings, wherein.

DETAILED DESCRIPTION OF THE INVENTION

Figure 1B:
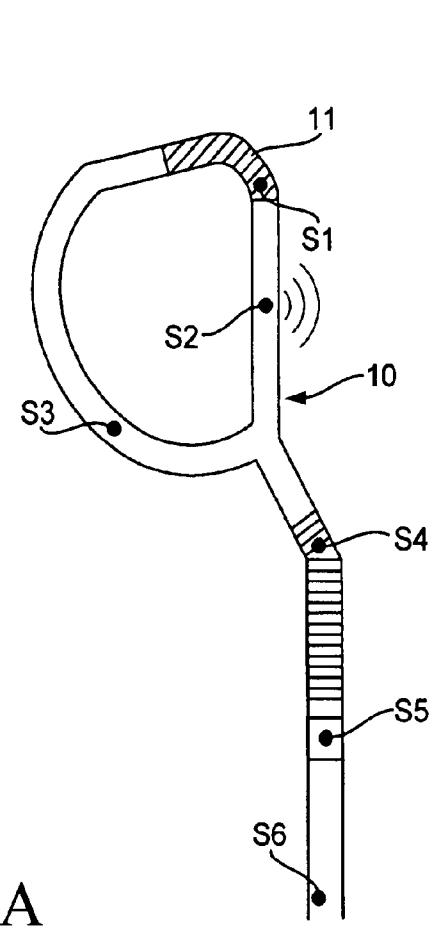
FIGS. 1A and 1B are schematic depictions of a cross-sectional view and a top view, respectively, of a tunnel system equipped with mobile sensors.
Figure 1A:
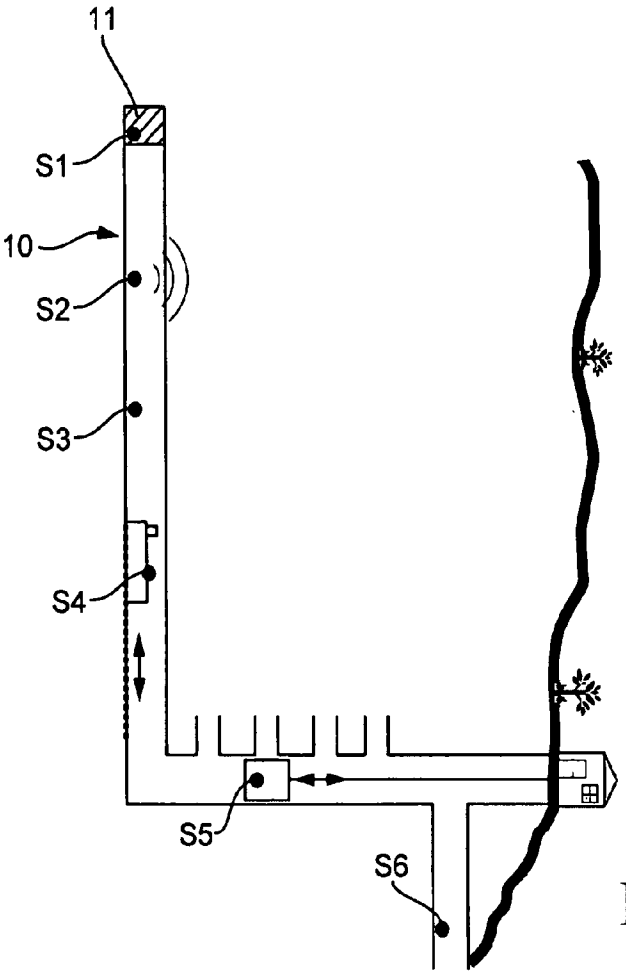

FIGS. 1A and 1B schematically depict a tunnel system, for example in a mine, equipped with or having a plurality of mobile sensors S1, S2, . . . , S6 that are assigned to different mobile users such as persons, for example a person in a hazardous area 11, an employee transmitting a distress call, a guided tour, a railway, an elevator, and another employee, and can be provided with corresponding identifications. FIG. 1B shows a top view of the tunnel system 10 according to FIG. 1A.

Figure 2B:
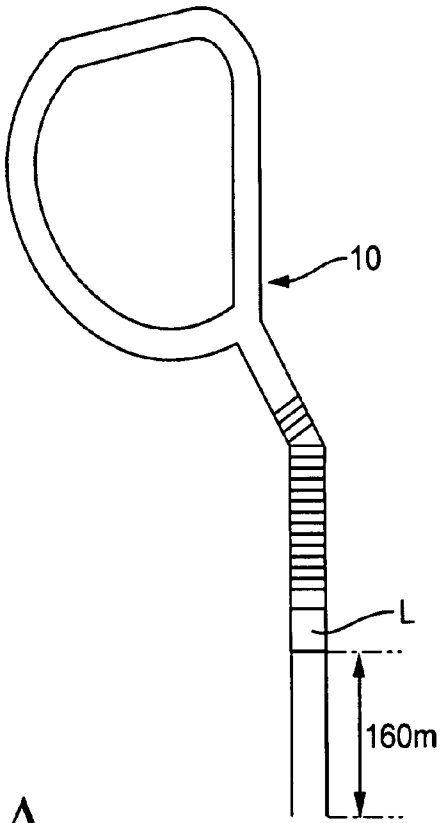
FIGS. 2A and 2B show a cross-sectional view and a top view, respectively, of the tunnel system according to FIGS. 1A and 1B, without mobile sensors, but with devices that cause interference.
Figure 2A:
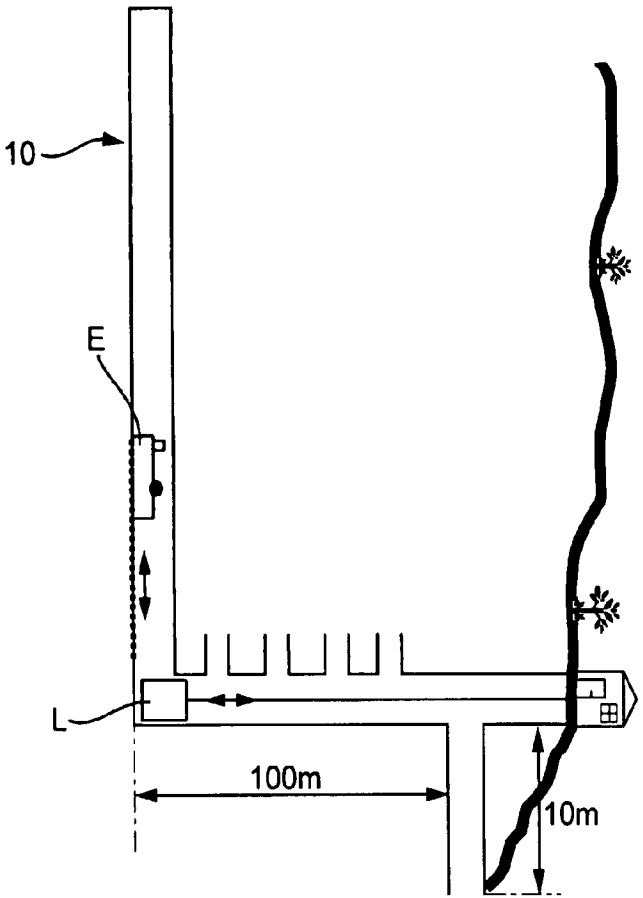

FIGS. 2A and 2B show the tunnel system 10 according to FIGS. 1A and 1B, without the mobile sensors S1, S2, . . . , Sn, but with the railway E and the elevator L, which can produce signal interference for the sensor signals of the mobile sensors S1, S2, . . . , Sn.

Figure 3:
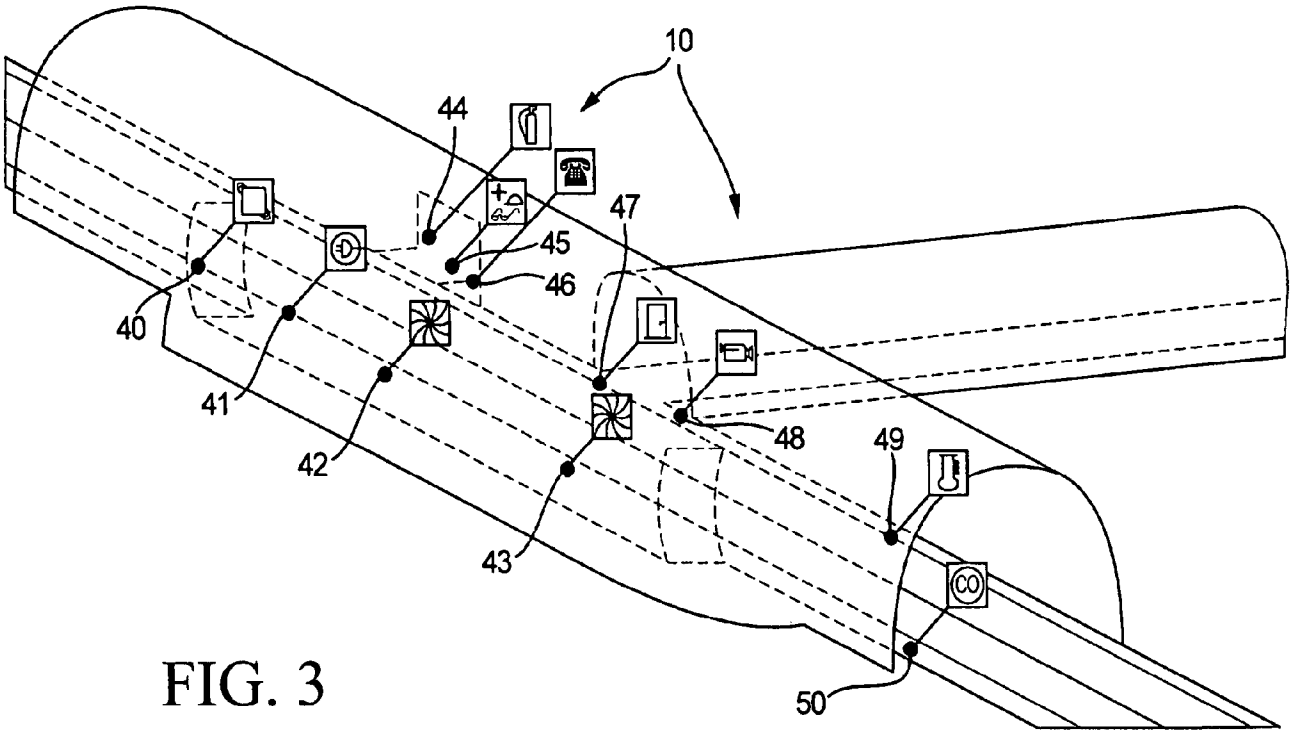
FIG. 3 is a perspective view of a segment of a tunnel system equipped with stationary sensors for physical states to be monitored.

As shown in FIG. 3, the tunnel system 10 can also contain stationary sensors 40, 41, . . . , 50 that can, for example, relate to a vandalism sensor, a voltage detector, a function sensor for fans, a sensor of a CO-measuring device, a temperature sensor, a video-monitoring camera, an access sensor, telephones, first aid devices, a fire extinguisher, and the like such as smoke detectors, humidity sensors, dust sensors, gas sensors, sensors for radioactive materials, and also a plurality of such devices.

Figure 4:
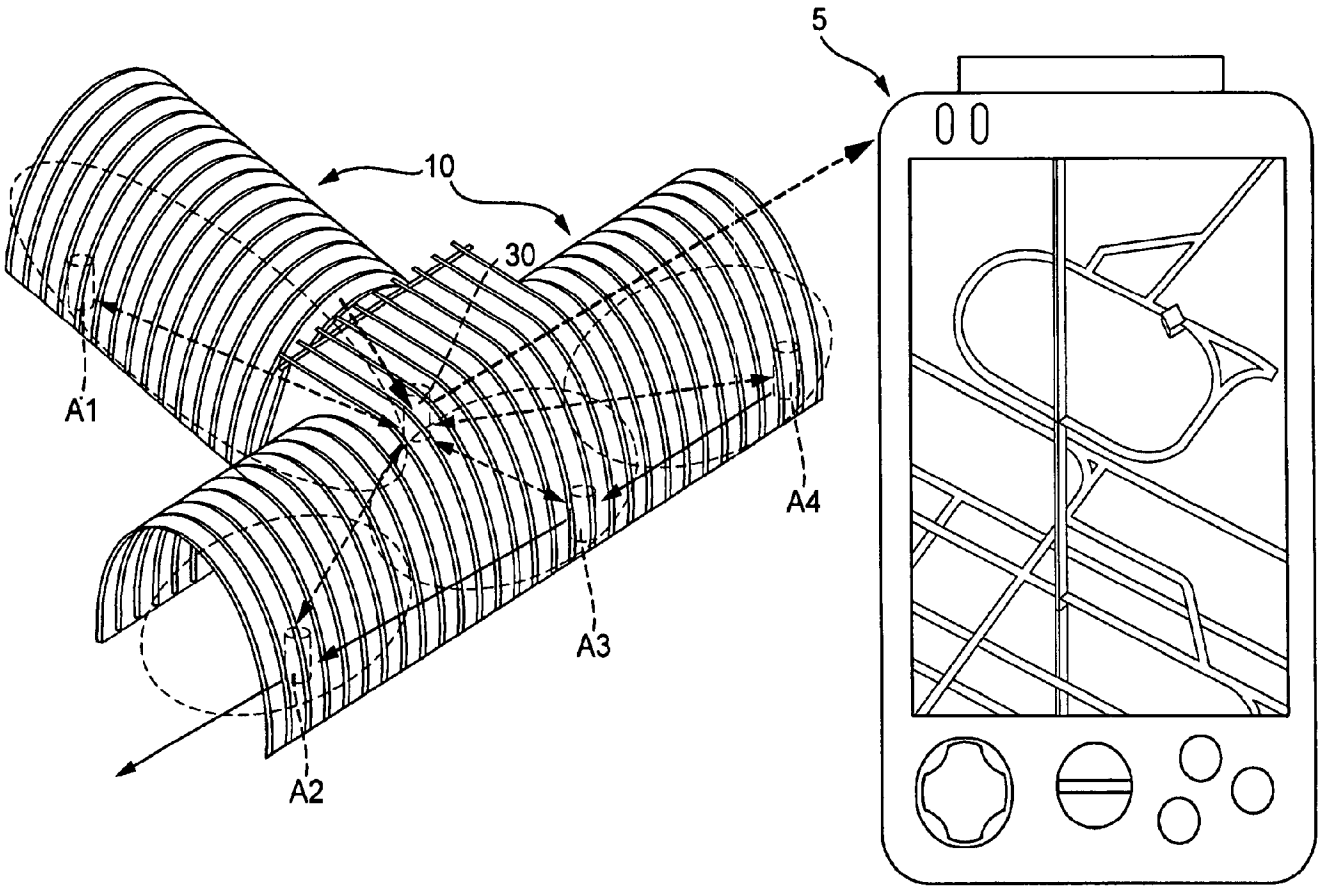
FIG. 4 shows a segment of a tunnel system with transceiver units situated at stationary anchor points, with a movable object, and with an evaluation unit of an evaluation device.
Figure 6:
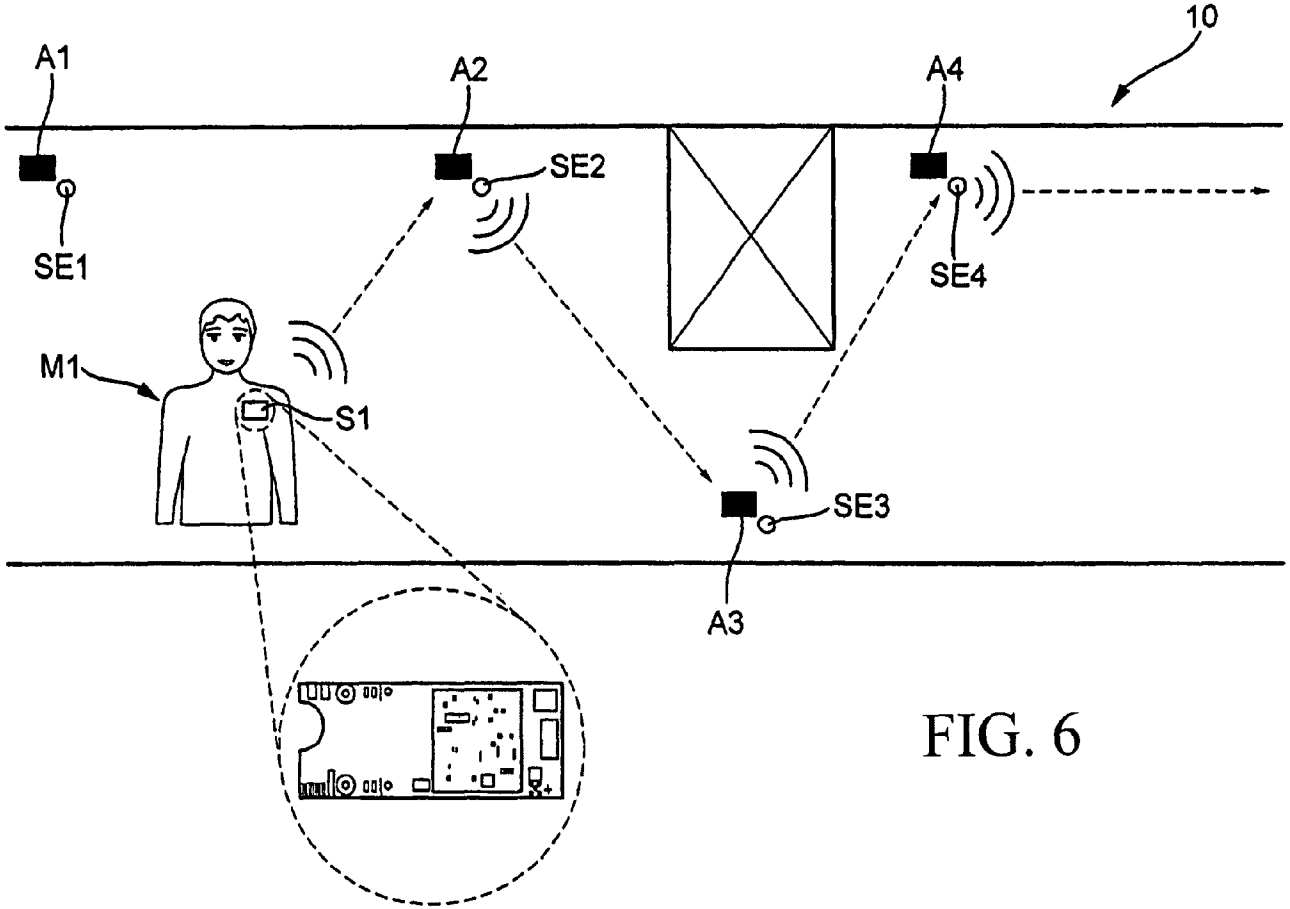
FIG. 6 is a schematic depiction of a segment of a tunnel system equipped with an exemplary embodiment for a data transmission.

FIG. 4 shows a branch point within the tunnel system 10, with anchor points A1, A2, A3, A4 positioned in the branching tunnels, to which are connected stationary transceiver units (SE1, . . . , SE4, see FIG. 6). The transceiver units (SE1, . . . ,SE4) can be used to monitor the position of a moving object 30, in particular a person. For this purpose, provided that they are in range, the transceiver units (SE1, . . . , SE4) remain, via wireless data connections, in a data-transmitting connection with the mobile sensor assigned to the moving object 30. The data can then be forwarded by the transceiver units (SE1, . . . , SE4) and transmitted to an evaluation unit 5, such as in the form of a mini computer or a hand-held computer with a display unit and/or can be forwarded by the moving object 30 via its mobile sensor. In any case, the detection data that are transmitted to the evaluation unit 5 contain information for the position determination and evaluation in the evaluation unit 5. The location of the moving object 30, in particular of a relevant person, can be displayed in a larger-context overview on the display unit. For this purpose, data about the tunnel system, provided that they exist or in the case of an advancing motion, provided that they can be reestablished, can also be stored in the evaluation unit 5 along with graphic and/or alphanumeric position information, for example two-dimensional or three-dimensional route plans, hazardous areas, distance information, prominent locations, or the like.

A display unit provided on a portable mini computer carried by a person in danger or by rescue workers can display a three-dimensional position depiction of the person's surroundings, with the person's position depicted and optionally, the position of a person to be rescued. Important additional information, such as hazard level, can be indicated on the display, such as by a red or yellow highlighting of hazardous areas or corresponding colored or flashing depiction of the persons themselves. In this case, it is possible to provide an interactive view of all locations in the respective tunnel areas or operating environment, permitting the user to rotate the operating environment and to zoom in and out. In this case, through continuous adaptation of the location data to the carried and thus mobile hand-held computer of the rescue workers and/or of the person in danger, the relevant data are displayed in the correct position in the respective operating environment. In addition to the person's position, it is also possible to display the positions of other persons or mobile nodes.

Figure 5:
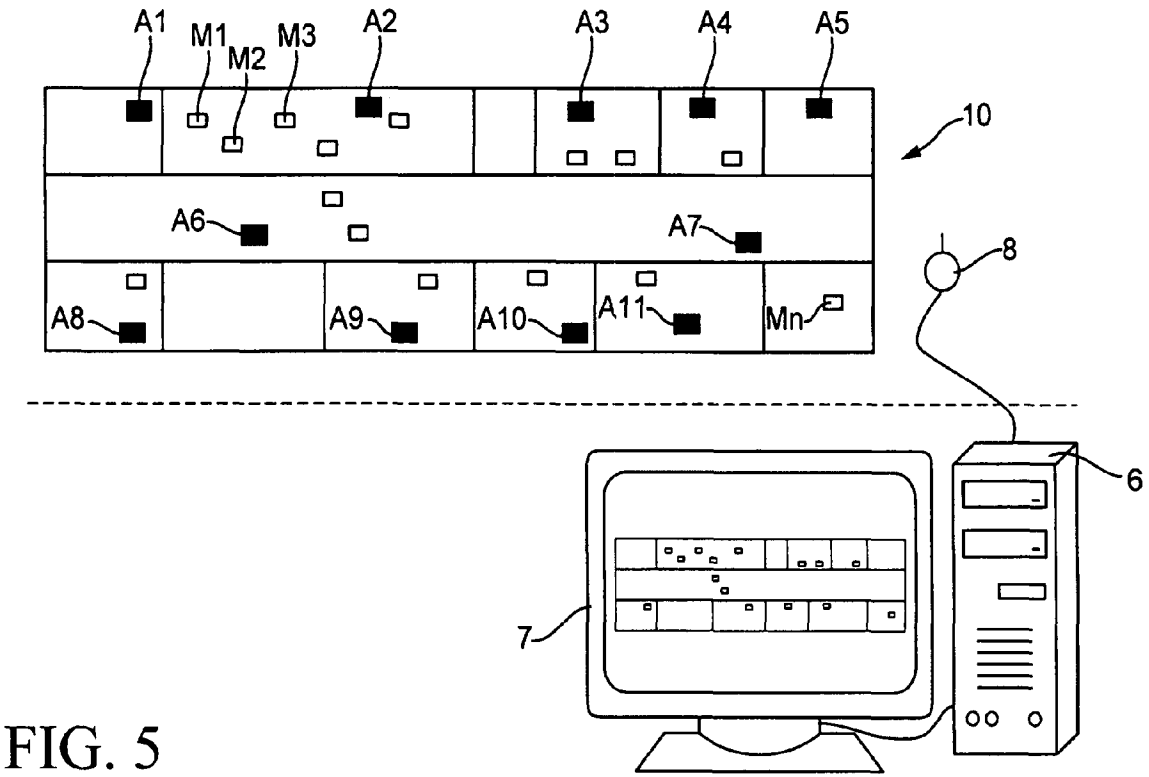
FIG. 5 schematically depicts a tunnel system equipped with a plurality of anchor points for transceiver units, with a multitude of mobile users, and with an evaluation device.

FIG. 5 schematically depicts a segment of the tunnel system 10 equipped with a multitude of anchor points A1, A2, . . . , A11 and a plurality of mobile users M1, M2, . . . , Mn situated in the tunnel system 10. The mobile users M1, M2, . . . , Mn are each equipped with respective mobile sensors S1, S2, . . . , Sn, which have respective transmission interfaces for a wireless signal transmission, in particular via radio, and are advantageously embodied for bi-directional transmission. In addition, the mobile sensors S1, S2, . . . , Sn can be equipped with respective identifications. The identifications are also stored in an evaluation device 6, which is brought into a wired or wireless data-transmission connection to the transceiver units via an interface 8 and which also communicates with a visual display device 7 on which at least parts of the tunnel system can be displayed, with the relevant mobile users M1, M2, . . . , Mn in their respective positions. The detection data can be supplied, such as in a wired or wireless fashion, from the transceiver units, which are situated at the anchor points A1, A2, . . . , An, via respective interfaces attached to them, directly to the evaluation device 6 via its interface 8 or can be relayed from transceiver unit to transceiver unit and then from a suitable transceiver unit to the evaluation device 6. The interfaces of the transceiver units and of the evaluation device 6 are advantageously designed for a bi-directional transmission.

FIG. 6 shows the transmission of sensor signals from a mobile user M1 to the transceiver unit SE2 at an anchor point A2 or node, and then on to other anchor points An, or more precisely stated, to their transceiver units SEn.

Figure 7:
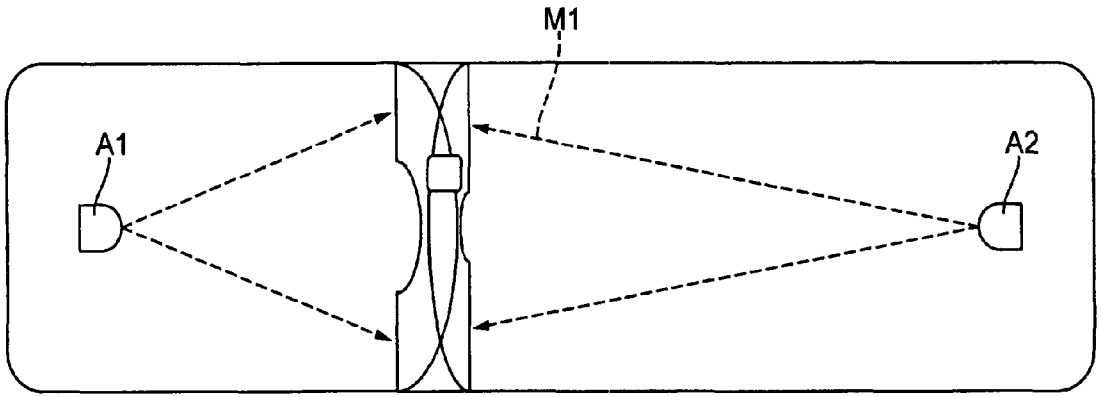
FIG. 7 shows an example for detecting the position of a mobile user in a segment of the tunnel system.

FIG. 7 schematically depicts a position determination of a mobile user M1 based on distance measurements from anchor points A1 and A2. For example, a triangulation method, a travel time measurement, and/or a measurement by signal strength can be used for the position determination. The detection data that are received by the transceiver units are in particular offset against one another and evaluated with programs stored in the evaluation device 5, 6.

Figure 8:
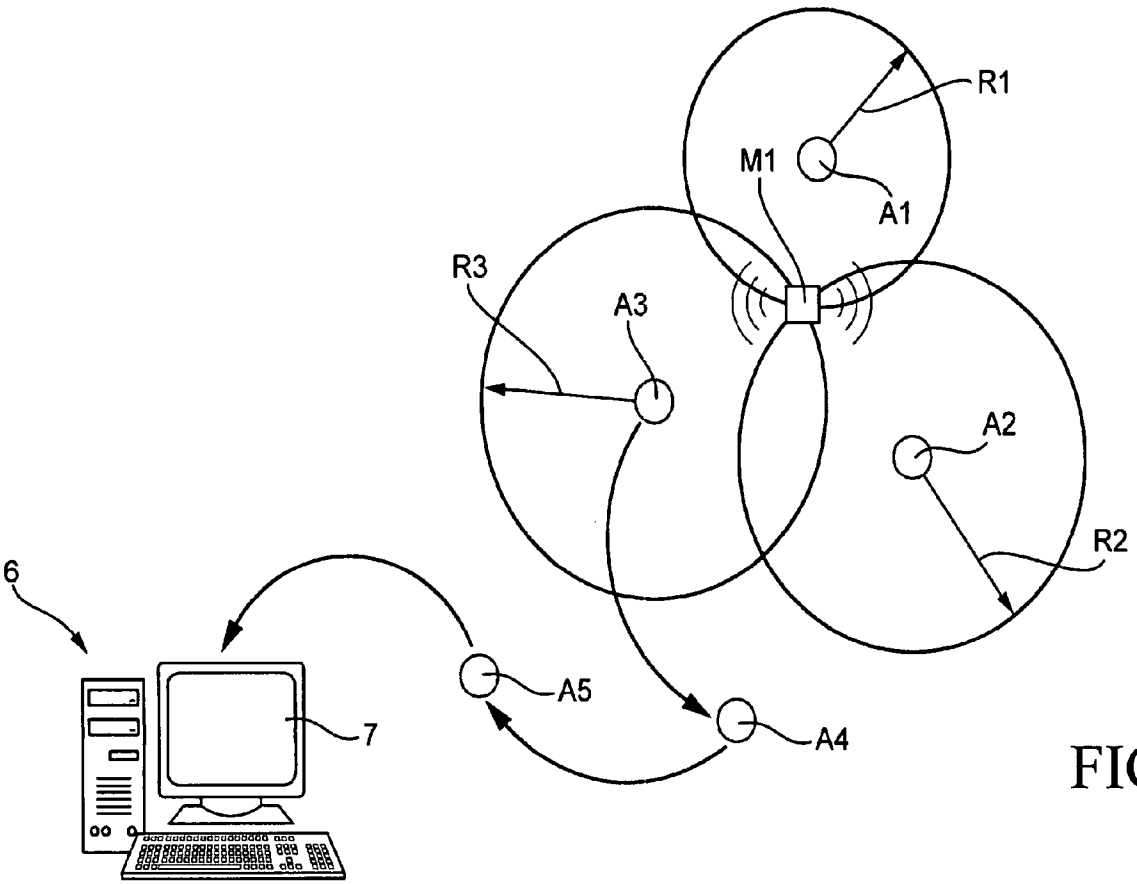
FIG. 8 is a schematic depiction of an exemplary embodiment for a position determination in the tunnel system.

FIG. 8 shows an example of the position determination of a mobile user M1 through a distance measurement by three transceiver units at anchor points A1, A2, and A3, which determine respective distances R1, R2, R3 from the mobile user M1. The position of the mobile user M1 is situated at the intersection point of the three circles, each with the radius of the respective distance from the anchor point to the mobile user. The detection data are forwarded from node to node via the anchor points A3, A4, and A5, reaching the evaluation device 6 with the display unit 7, where they are assigned to the location within the tunnel system 10 and displayed topologically or topographically along with the location.

Figure 9:
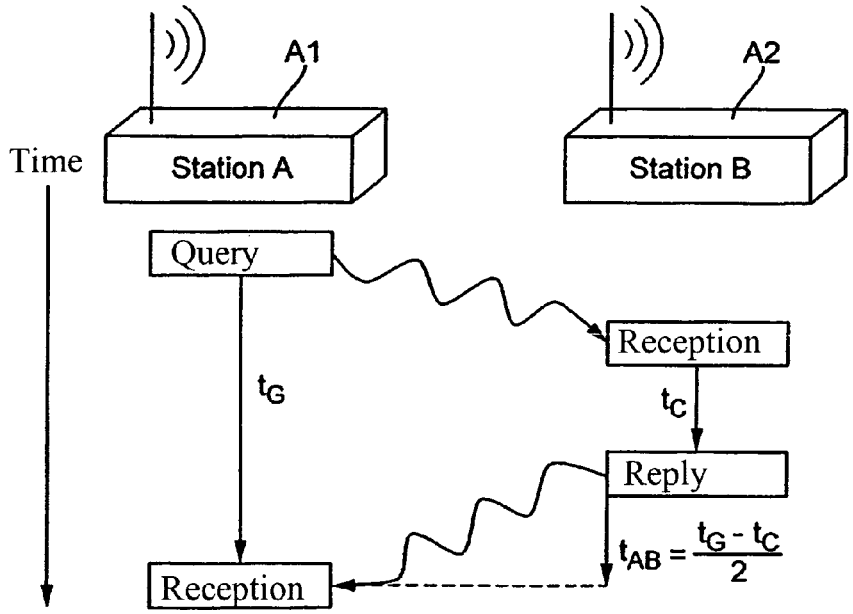
FIG. 9 shows one example for the procedure in a position determination.

FIG. 9 shows an example of the method for determining the distance to a mobile user by anchor points or nodes A1, A2, using respective travel times and time delays. In this case, a sort of double travel time measurement is used, which achieves an increased precision in the position determination by eliminating imprecisions of interval timers.

Figure 10:
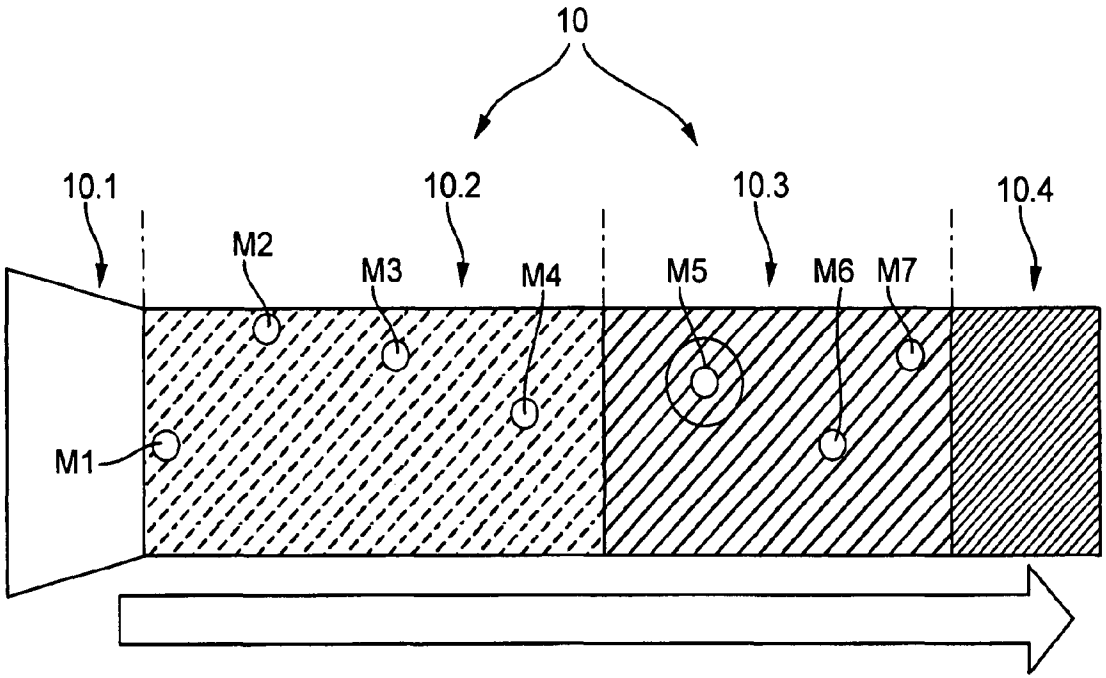
FIG. 10 is a schematic depiction for dividing a tunnel segment into different hazard areas.
Figure 11:
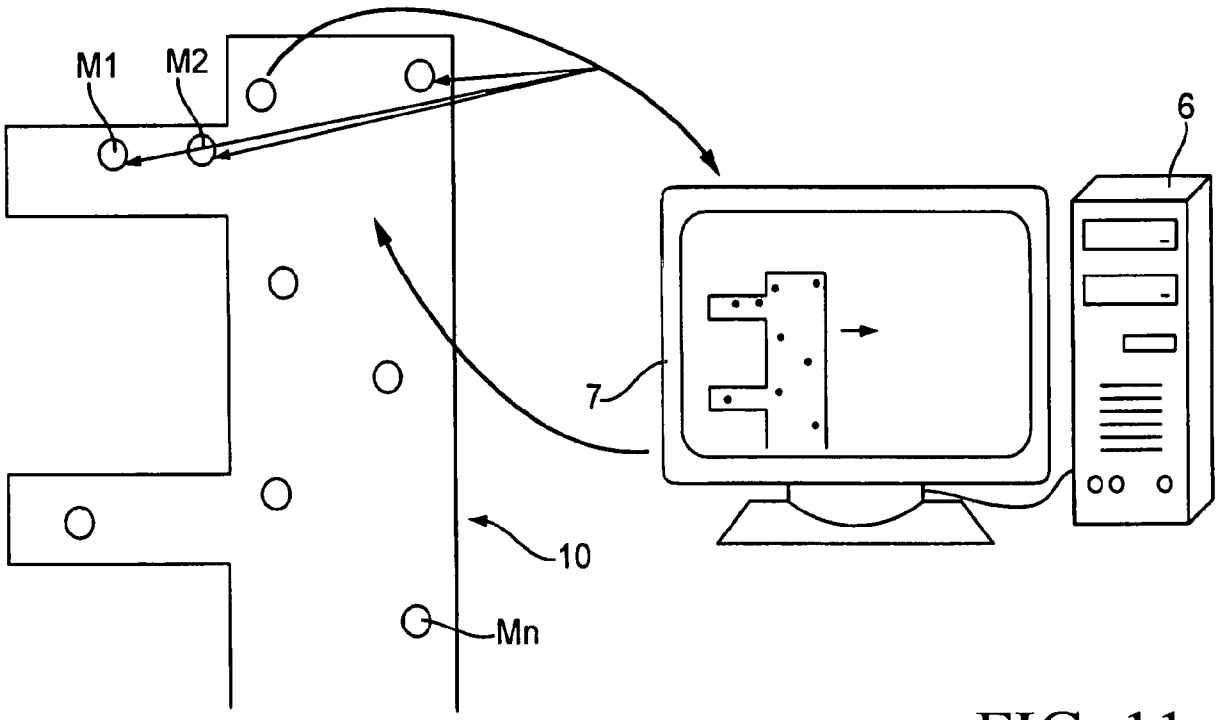
FIG. 11 is an exemplary embodiment for data transmission from a tunnel segment to an evaluation device, with a depiction on a display unit.

FIGS. 10 and 11 show an advantageous embodiment of the position-monitoring device. The tunnel system is divided into different hazard areas in subsections 10.1, 10.2, 10.3, 10.4 . . . . In subsection 10.1, which constitutes or forms a main entrance for example, all persons, visitors and employees, are detected. Visitors and employees M1, M2, M3 are permitted to enter subsection 10.2, which constitutes or forms a completed section, for example. Entry into subsection 10.3, which is still undergoing active work, is only permitted for trained skilled workers. Alarm signals can be triggered if visitors enter.

Subsection 10.4 contains a hazardous area, such as where explosives are in use. A warning system is provided for mobile users located in this area.

For example, the alarm system or warning system for the mobile users M1, M2, . . . , Mn is designed so that optical and/or acoustic signals are transmitted to the users by a signaling device. The transmission system can be an independent system with its own data-transmission paths or can make use of the data-transmission paths of the position-monitoring device. For example, the persons to be monitored can be equipped with warning display units, possibly in connection with the mobile sensors S1, S2, . . . , Sn themselves, or alarm or warning components, such as lamps, other visual displays, acoustic signaling devices, or piezo-vibration alarms, can be installed in the subsections 10.1, 10.2, 10.3, and 10.4. In addition, the signaling system for alarms and warning signals for purposes of personnel monitoring can be equipped, for example, to detect biometric data when the persons constituting the mobile users M1, M2, . . . , Mn are equipped with corresponding mobile measuring components or with stationary sensors for physical state values, such as temperature, gas, radioactivity, or the like. All detected data are received in the evaluation device 6, offset against one another, and used, for example, to issue a suitable warning signal to notify a person in a hazardous area about the dangerous situation, such as the occurrence of a high CO level or dust level or the presence of methane gas. In addition, inspectors or another employee squad can be alerted if a person gets into a dangerous situation and for example, can no longer free himself from it. This can be determined by conversing with the affected person or by evaluating physiological parameters such as blood pressure, respiration, movement (EKG), and the like that are detected by vital sign sensors. Before critical values are reached, the affected person in jeopardy is warned by an optical, acoustic, or tactile alarm unit such as a piezo-vibrator. In a control room equipped with an evaluation device that is supplied with detection data or at least essential informational data such as warnings triggered, when critical values or values that constitute or form a health hazard are detected, an emergency call to the person in danger or if need be, to support personnel, is triggered and/or rescue scenarios are suggested.

To support rescue workers or a foreperson in a control room, the evaluation device is equipped with operations-monitoring software, which, in an emergency situation, assists the involved persons, a person requiring rescue, or the rescue workers or support personnel as they handle the crisis situation. The operations-monitoring software detects the mobile nodes in the relevant areas of the tunnel system and calculates safe, short escape routes. The most effective possible entry path is suggested to rescue workers and they are provided with visual, acoustic, and in particular, spoken information.

Furthermore, an acceleration sensor assigned to a respective mobile node three-dimensionally detects the x, y, and z coordinates of a carrier position. This makes it possible to establish a dead man switch function by evaluating either the position, the horizontal position for a definite length of time, or the movement of the involved person, motionless for a definite length of time. When the dead man switch is triggered, an emergency call including the position data, for example, is issued via the sensor network equipped with the mobile and/or stationary sensors S1, S2, . . . , Sn; 40, 41, . . . , 50. In the control center, suitable rescue scenarios are proposed based on the sensor data.

Sensors assigned to the mobile nodes measure the environmental influences such as CO concentration, dust level, radioactivity, fire hazard, or the like and the sensor values are assigned to the position and transmitted via the sensor network. The evaluation device, or more precisely stated, the monitoring software in the control room, collects and evaluates all sensor data. Based on these data, a map of harmful environmental influences is produced and visually displayed. When predetermined or predeterminable threshold values are exceeded, an alarm is triggered and a rescue scenario is proposed. In addition, the curve of influences is recorded, saved, and evaluated by stored algorithms. For example, if clouds of gas are converging, the system can detect dangerous situations even before they arise and can inform or warn persons or rescue workers in danger.

The wireless data transmission via radio uses a so-called chirp spread spectrum by which interference effects present in the tunnel can be advantageously separated out from the useful signals. By using different frequencies, the transmission method and evaluation method in this case offer an improved reception of useful signals by comparison with those otherwise achieved using a conventional radio transmission technique. For example in a particular tunnel environment, a frequency range of around 2.4 GHz is advantageous.

The measures according to this invention achieve significant advantages for determining the position of persons and monitoring them, particularly in a tunnel system 10.

The invention claimed is:

1. A position-monitoring device for persons in a tunnel system (10), having an evaluation device (5, 6), the position monitoring device comprising:

a locally distributed arrangement of transceiver units (SE1, . . . , SE4) each equipped with a wireless data-transmission device and installed in spaces to be monitored in the tunnel system (10) at fixed anchor points (A1, A2, . . . , An) known to the evaluation device (5, 6);

the tunnel system (10) being divided into subsections (10.1, 10.2, 10.3, 10.4) classified into different hazard levels, and related classification data are stored in the evaluation device (5, 6) and are or can be associated with determined position data;

the persons equipped with mobile sensors (S1, S2, . . . , Sn);

the transceiver units equipped with data-transmission interfaces by which can be placed in a wireless data-transmitting connection to the mobile sensors (S1, S2, . . . , Sn) and placed in a wired or wireless data-transmitting connection to the evaluation device (5, 6); and programs determining a subsection position of the persons on a basis of detection data of the transceiver units being stored in the evaluation device (5, 6).

2. The position-monitoring device as recited in claim 1, wherein mobile and/or stationary sensors (S1, Sn; 40, . . . , 50) for detecting hazardous states of the persons and/or hazardous areas in the tunnel system are provided and the evaluation device (5, 6) is embodied to detect dangerous situations.

3. The position-monitoring device as recited in claim 2, wherein the evaluation device (5, 6) determines the position on a basis of simultaneous detection data from a plurality of transceiver units by triangulation.

4. The position-monitoring device as recited in claim 2, wherein the evaluation device (5, 6) determines the position on a basis of travel time measurements of signals of the mobile sensors (S1, S2, . . . , Sn) and/or on a basis of signal strengths by the detection data.

5. The position-monitoring device as recited in claim 4, wherein the data-transmission paths between the mobile sensors (S1, S2, . . . , Sn) and the transceiver units and/or the data-transmission paths between the evaluation device (5, 6) and the transceiver units each is embodied to be bi-directional.

6. The position-monitoring device as recited in claim 5, wherein the transceiver units are installed in existing devices of an electrical installation.

7. The position-monitoring device as recited in claim 6, wherein a measurement system with stationary sensors (40, 41, . . . , 50) for physical states is installed in the tunnel system (10), the sensor data of the measurement system are supplied to the evaluation device (5, 6) to relate the sensor data to the detection data.

8. The position-monitoring device as recited in claim 7, wherein a personnel warning system is provided and warning signals are triggered by the evaluation device (5, 6) or the transceiver units depending on the position of the person.

9. The position-monitoring device as recited in claim 8, wherein personnel are assigned additional mobile sensors embodied for detecting vital signs including blood pressure, respiration, EKG, and/or movement and the evaluation device (5, 6) is embodied for evaluating detected vital signs.

10. The position-monitoring device as recited in claim 9, wherein the position-monitoring device is embodied for a three-dimensional position detection and display.

11. The position-monitoring device as recited in claim 10, wherein a guidance system assists support personnel in rescuing a person in danger.

12. The position-monitoring device as recited in claim 11, wherein the mobile and stationary sensors (S1, . . . , Sn; 40, . . . , 50) are embedded into the guidance system for the support personnel.

13. The position-monitoring device as recited in claim 12, wherein a radio transmission by the chirp spread spectrum technique is used for wireless data transmission.

14. The position-monitoring device as recited in claim 1, wherein the evaluation device (5, 6) determines the position on a basis of simultaneous detection data from a plurality of transceiver units by triangulation.

15. The position-monitoring device as recited in claim 1, wherein the evaluation device (5, 6) determines the position on a basis of travel time measurements of signals of the mobile sensors (S1, S2, . . . , Sn) and/or on a basis of signal strengths by the detection data.

16. The position-monitoring device as recited in claim 1, wherein the data-transmission paths between the mobile sensors (S1, S2, . . . , Sn) and the transceiver units and/or the data-transmission paths between the evaluation device (5, 6) and the transceiver units each is embodied to be bi-directional.

17. The position-monitoring device as recited in claim 1, wherein the transceiver units are installed in existing devices of an electrical installation.

18. The position-monitoring device as recited in claim 1, wherein a measurement system with stationary sensors (40, 41, . . . , 50) for physical states is installed in the tunnel system (10), the sensor data of the measurement system are supplied to the evaluation device (5, 6) to relate the sensor data to the detection data.

19. The position-monitoring device as recited in claim 1, wherein a personnel warning system is provided and warning signals are triggered by the evaluation device (5, 6) or the transceiver units depending on the position of the person.

20. The position-monitoring device as recited in claim 1, wherein personnel are assigned additional mobile sensors embodied for detecting vital signs including blood pressure, respiration, EKG, and/or movement and the evaluation device (5, 6) is embodied for evaluating detected vital signs.

21. The position-monitoring device as recited in claim 1, wherein the position-monitoring device is embodied for a three-dimensional position detection and display.

22. The position-monitoring device as recited in claim 1, wherein a guidance system assists support personnel in rescuing a person in danger.

23. The position-monitoring device as recited in claim 22, wherein the mobile and stationary sensors (S1, . . . , Sn; 40, . . . , 50) are embedded into the guidance system for the support personnel.

24. The position-monitoring device as recited in claim 1, wherein a radio transmission by the chirp spread spectrum technique is used for wireless data transmission.

25. The position-monitoring device as recited in claim 17, wherein the transceiver units are installed in lights and/or components of a signaling device.

26. A position-monitoring device for persons in a tunnel system (10) divided into subsections (10.1, 10.2, 10.3, 10.4) classified into different hazard levels, the position monitoring device comprising:

an evaluation device (5, 6) storing classification data of the subsections that are or can be associated with determined position data;

an arrangement of transceiver units (SE1, . . . , SE4) each equipped with a wireless data-transmission device and installed in one of the subsections to be monitored in the tunnel system (10) at fixed anchor points (A1, A2, . . . , An) known to the evaluation device (5, 6);

mobile sensors (S1, S2, . . . , Sn);

the transceiver units equipped with data-transmission interfaces by which can be placed in a wireless data-transmitting connection to the mobile sensors (S1, S2, . . . , Sn) and placed in a wired or wireless data-transmitting connection to the evaluation device (5, 6); and programs determining a subsection position of the mobile sensors on a basis of detection data of the transceiver units being stored in the evaluation device (5, 6).

* * * * *